US006925739B1

(12) United States Patent
Cole et al.

(10) Patent No.: US 6,925,739 B1
(45) Date of Patent: Aug. 9, 2005

(54) CALENDAR BOX AND STAND

(75) Inventors: Jeffrey C. Cole, Arvada, CO (US); Kenneth H. Fleck, Littleton, CO (US); Heather S. Fleck, Littleton, CO (US)

(73) Assignee: Accord Publishing, LTD, Denver, CO (US)

( * ) Notice: Subject to any disclaimer, the term of this patent is extended or adjusted under 35 U.S.C. 154(b) by 0 days.

(21) Appl. No.: 10/442,681

(22) Filed: May 21, 2003

(51) Int. Cl.[7] ..... G09D 3/04
(52) U.S. Cl. ..... 40/120; 206/45.2
(58) Field of Search ..... 40/107, 119, 120, 40/121; 206/45.2, 45.23; 283/2

(56) References Cited

U.S. PATENT DOCUMENTS

| | | | | |
|---|---|---|---|---|
| 1,169,738 A | | 1/1916 | Smiley | 283/2 |
| 1,347,839 A | * | 7/1920 | Coons | 206/45.23 |
| 1,939,824 A | * | 12/1933 | Mix et al. | 206/45.23 |
| 1,989,159 A | * | 1/1935 | Gross et al. | 206/45.23 |
| 2,263,528 A | | 11/1941 | Wissman | 283/2 |
| 2,284,256 A | | 5/1942 | Benrath | 273/302 |
| 2,285,235 A | * | 6/1942 | Taubert | 40/120 |
| 2,789,836 A | * | 4/1957 | Jeannin | 40/120 |
| 2,889,036 A | * | 6/1959 | Davies | 206/45.2 |
| 2,954,625 A | | 10/1960 | Nichols | 40/170 |
| 4,259,568 A | * | 3/1981 | Dynesen | 206/45.2 |
| 4,368,817 A | * | 1/1983 | Temesvary | 206/45.2 |
| 4,757,624 A | | 7/1988 | Holec | 40/119 |
| 4,951,968 A | | 8/1990 | Adams | 281/45 |
| D311,025 S | | 10/1990 | Bermack | D19/21 |
| 5,062,229 A | | 11/1991 | Werjefelt | 40/107 |
| 5,259,132 A | | 11/1993 | Leonard | 40/107 |
| 5,273,155 A | | 12/1993 | Sala | 206/756 |
| 5,480,118 A | | 1/1996 | Cross | 248/459 |
| 5,661,918 A | | 9/1997 | Malcolm et al. | 40/107 |
| 5,803,497 A | | 9/1998 | Suess | 40/107 |
| 6,119,851 A | * | 9/2000 | Paciello | 206/45.23 |
| 6,493,969 B2 | | 12/2002 | Devos | 40/120 |
| 6,588,128 B2 | * | 7/2003 | Whang | 40/121 |

FOREIGN PATENT DOCUMENTS

| | | |
|---|---|---|
| DE | 0 261 277 | 11/1986 |
| FR | 2 547 243 | 6/1983 |

OTHER PUBLICATIONS

Figures A-F (6Pages) DIfferent perspectives of calendar case.
Photo Copies of Workman Calendar (9 Pages).

* cited by examiner

*Primary Examiner*—Lars A. Olson
(74) *Attorney, Agent, or Firm*—Aileen Law; Patent Law Offices of Rick Martin, P.C.

(57) ABSTRACT

The present invention is a multi-functional box that serves as packaging, calendar stand, and as storage/carrying case. Whereas the commonly known "boxed calendars" that are currently available in the marketplace are comprised of an outer carton for packaging that is thrown away, a bound pad of paper, and a plastic calendar stand that may also be discarded, the present invention quickly and conveniently opens from its closed and locked storage/transport position to become a tilt back calendar stand for a daily calendar or pad of paper. The calendar stand can be quickly closed back into its original closed position and secured with a locking system. Stored within the box are loose sheets of paper that comprise the calendar. Further, each calendar page may provide an activity function through the present invention, that is either allowed or improved through its use of unbound pages, self-storage of said pages, and the ability to easily insert ancillary items necessary for certain activities.

44 Claims, 9 Drawing Sheets

600
128
400
120
500
100
300
200

126
800
160

128
400
120

180
120
600

CALENDAR BOX AND STAND

FIELD OF THE INVENTION

The present invention relates generally to a calendar, and in particular to a daily calendar individually displaying the days of a year having a box that quickly and conveniently opens to become a decorative tilt back calendar stand.

BACKGROUND OF INVENTION

Common to the calendar industry are daily calendars commonly referred to as "page-a-day" calendars as trademarked by Workman Publishing. Such calendars are also known as "daily calendars" and "boxed calendars" and are typically made of approximately 365 printed sheets of paper (pages) whereby each page represents individual days of the year. The pages are collated and assembled into a pad, bound on one side (similar to a tear-away note pad), attached to a secondary support frame (easel) having a pull out "kick stand" (similar to a desktop picture frame) and finally, inserted into a secondary display carton for retail sale. When in use, single pages are torn from the pad with the passing of each date.

Accord Publishing sought to produce various new calendar concepts and improve its existing calendar titles using currently available boxed calendar formats only to learn that the traditional boxed calendar format previously described did not provide the necessary functionality. Accord Publishing needed a calendar method that allowed individual pages to remain undamaged versus the torn and frayed edges that result when removing pages from a bound pad. A method was needed that allowed individual pages, once used, to be stored within the calendar for future use. A method was needed to accommodate the insertion and repositioning of ancillary items such as index cards, tabs, metal boards, etc., which function was not feasible with a bound pad. And finally, a more cost efficient, more environmentally friendly method was needed whereby the packaging would also serve as an easy to use tilt-back easel, eliminating the need for secondary (throw-away) retail display cartons and secondary (plastic or paper board) easels. Accordingly, it was necessary for Accord Publishing to create a new, all inclusive, daily calendar system that ensured undamaged paper removal, self storage of calendar pages, and the ability to insert various ancillary items between pages, via a multi-functional container—all of which were not possible through the use of existing boxed calendar formats.

Accord Publishing invented a new calendar system through the creation of its revolutionary Easy Fold-a-Round™ Calendar Box. This box enables the calendar pages to be loose, versus bound along a common edge, thereby eliminating the damage caused to pages when torn from a bound pad. This box provides self storage because the loose pages can be moved to the back of the box. This box accommodates the insertion and repositioning of ancillary items (index cards, tabs, metal boards, etc.) between calendar pages as these various items slide in and out between loose calendar pages when the box is opened. And finally, this is a multi-functional container that serves as a retail display carton which easily converts into an easel, thereby eliminating the need for secondary display cartons and secondary easels.

The Easy Fold-a-Round™ Calendar Box invention now makes it possible for Accord Publishing to create all new calendar titles and greatly improve other existing calendar titles. For example, Accord may now offer a boxed calendar titled Tangram—Magnetic Puzzle-a-Day™ Calendar. This calendar is made possible through this invention because a metal sheet can slide in and out between loose calendar pages so that seven magnetic shapes may magnetically attach to the calendar page viewed at the front of the calendar. As the year progresses, the metal sheet is easily moved toward the back of the box. Additionally, the user may store the calendar pages (and other components) within the calendar should they wish to save the calendar pages.

An example of how this invention allows great improvements to existing calendar titles is demonstrated with Accord Publishing's Easy Origami Calendar™. Origami (and other paper folding/craft hobbies) benefits greatly from the use of straight-edged paper and easily accessible instructions. Straight-edge paper is now possible with this invention because it holds loose sheets of paper versus bound pages that are damaged when torn from a pad. This invention also enables origami instructions, which were previously provided separate from the calendar, to be inserted within the Calendar as tabbed cards. And finally, there is now no need to produce a secondary (throw-away) retail display carton or a secondary plastic stand since the Easy Fold-a-Round™ Calendar Box is both display carton and easel.

The present invention, Easy Fold-a-Round™ Calendar Box, provides necessary and specific innovations to daily or boxed calendar format calendars. This newly designed box serves as a retail display carton having a front cover that quickly converts (folds around) into a tilt back easel stand that can support over 365 daily calendar pages. Just as easily, it folds back into a closed front cover position in a single, nearly automatic motion. The box is comprised of paper board material. The front cover consists of paper board panels that are hingedly connected. Magnets are inserted within the paperboard and are used to conveniently and rapidly hold the lid in place. Specific improvements include loose calendar pages, self storage of calendar pages and associated components, insertion of ancillary components between loose calendar pages, and a display carton that also serves as tilt-back calendar easel via a single, easy motion.

The Easy Fold-a-Round™ Calendar Box invention should not be confused with numerous other calendar related inventions which generally relate to a) Calendars having pages that are bound along a common side (i.e. spiral bound or glued). b) Calendars that do not include storage space for "used" calendar pages. c) Calendars having a weekly or monthly format per single calendar page versus a boxed calendar format which displays a single day at a time. d) Calendars that require secondary retail display cartons and secondary easels, separate from the display carton. e) Self standing calendars having an easel like support structure requiring multiple steps for set-up (versus one simple "fold-a-round" motion that does not require removing interior contents) and/or that do not have a tilt back easel function, an easy opening and closing function, or that utilize a construction that is commonly known in the art.

a) Illustrative of calendars having pages that are bound along a common side include: U.S. Pat. No. 5,062,229 issued to Werjefelt; U.S. Pat. No. 4,757,624 issued to Holec; U.S. Pat. No. 2,263,528 issued to Wissman; U.S. Pat. No. 1,169,738 issued to Smiley; U.S. Pat. No. 5,661,918 issued to Malcolm; U.S. Pat. No. 5,480,118 issued to Cross; U.S. Pat. No. 6,493,969 B2 issued to Devos; U.S. Pat. No. 2,954,625 issued to Nichols; U.S. Pat. No. 5,273,155 issued to Sala; and European Pat. No. EP 261,277.

b) Illustrative of calendars that do not include storage space for "used" calendar pages include: U.S. Pat. No.

5,062,229 issued to Werjefelt; U.S. Pat. No. 4,757,624 issued to Holec; U.S. Pat. No. 2,263,528 issued to Wissman; U.S. Pat. No. 1,169,738 issued to Smiley; U.S. Pat. No. 5,661,918 issued to Malcolm; U.S. Pat. No. 5,480,118 issued to Cross; U.S. Pat. No. 6,493,969 B2 issued to Devos; U.S. Pat. No. 2,954,625 issued to Nichols; U.S. Pat. No. 5,273,155 issued to Sala; and European Pat. No. EP 261,277.

c) Illustrative of calendars having a weekly or monthly format per single calendar page versus a boxed calendar format which displays a single day at a time include: U.S. Pat. No. 5,661,918 issued to Malcolm; U.S. Pat. No. 5,062,229 issued to Werjefelt; U.S. Pat. No. 5,803,497 issued to Suess; U.S. Pat. No. 6,493,969 B2 issued to Devos; European Pat. No. EP 261,277.

d) Illustrative of calendars that require secondary retail display cartons and secondary easels, separate from the display carton, include: the hundreds of boxed calendar format calendars currently available in the marketplace.

e) Illustrative of self standing calendars having an easel like support structure requiring multiple steps for set-up (versus one simple "fold-a-round" motion that does not require removing interior contents) and/or that do not have a tilt back easel function, an easy opening and closing function, or that utilize a construction that is commonly known in the art include: U.S. Pat. No. 5,803,497 issued to Suess (requires multiple steps for set up such as opening a flap, removing calendar playing cards, closing previously opened flap, severing perforation lines, folding back holder portion, inserting "tip" into holder, and re-inserting calendar playing cards); U.S. Pat. No. 5,273,155 issued to Sala; U.S. Pat. No. 4,951,968 issued to Adams; and French Pat. No. FR 2,547,243.

The present invention teaches how a calendar's front cover or lid quickly converts into a tilt back kick-stand, then quickly converts back into a closed front cover position in a near automatic motion by use of magnets to rapidly lock the hingedly connected panels into place as either a cover or stand. This-near effortless motion has a dual benefit to the prospective consumer: 1) prior to purchase, the prospect can quickly open the lid of the multifunctional box and examine the inner contents; and 2) upon purchase, the consumer can use the reclosable lid to enable transport, and reopen the lid at a desktop and reposition it into a displayable position without discarding the outer carton. In sum, the outer carton of the present invention also serves as the display and stand whereas the existing boxed calendar format calendars of today's market have a disposable outer carton.

The present invention allows the user to simply remove the expired calendar sheet from a front position of the display mount and optionally store it at a back position of the display mount. Furthermore, dividers, i.e. a set of index cards, sticky paper tabs, etc., can be inserted in between any date, and serve as, for example, a reminder for a birthday or anniversary. Thereafter, the present invention provides an alternative use for the calendar, which use remains after the date of the calendar page has long since passed. For example, the user may fold the outdated calendar page into an origami figure. Other examples could include arranging a set of magnetic pieces on each outdated calendar page to form new designs with the magnetic pieces, using the printed graphic art on each outdated calendar page as a cross-stitch or quilt pattern, or cropping the outdated calendar card to provide a decorative border, which is a popular craft called "scrapbooking." The user may also simply reuse each calendar card as a gift card.

The present invention also allows the user to display the calendar pages in a display mount that is a novel means of a slant-support display easel. There are a number of inexpensive slant-support display easels that basically consist of a means for positioning a slanting display or writing surface having easel support means. Usually the structure incorporates one or more vertical panels for displaying advertisements, slogans, logos, calendars, photographs, or the like. In the past, most of the art pertaining to such structures has been formed of relatively thick, substantially inflexible cardboard stock, with or without plastic facing layers. Such structures generally use a comparatively complex tongue and slot means to maintain the easel in operative position and rely on the strength of the materials and their thickness to provide stability during use. Moreover, their assembly is time-consuming.

The present invention comprises a container that can be converted from an open display case or calendar stand to a closed storage box. This box is multi-functional, and serves as packaging, as storage, as a calendar stand, and as a carrying case. In addition, the present invention provides an opportunity for a purchaser to examine the inner contents prior to purchase. The front lid of the box rotates around to the backside of the container to a semi-locked position thereby transforming the lid into a stand or an easel in an open mode. In a closed mode, a locking system holds the lid securely in place, thereby maintaining the interior contents during transport.

In the open display case configuration, the Suess container may be described as having a card display holder and a card storage holder. The card display holder and the card storage holder are joined together at a fold line that operates as a hinge, which may be adjusted to position one holder relative to the other holder about the hinge line. However, the inner card contents must be removed from the outer container to accomplish the opening or closing mode of the container. Further, Suess does not suggest that the container can be combined with a locking system. The present invention discloses a locking system comprising hook and loop, magnets, Velcro®, and/or other like devices. A second locking system can also be used to provide a secure upright and rigid stance when the present invention is configured as an open display case.

Recently, devices similar to compact disc jewel cases have been used to provide a card calendar whereby each card displays one month of a year. The jewel case opens and rotates about 300° upon a single hinge to become a tilt back calendar stand. The two-piece jewel case, however, is made of tongue and groove hard plastic and is thus, immovable except for the single hinge. Furthermore, the pivot point for a single hinged jewel case must be centered upon an axis away from the edge. The front lid of the present invention rotates about 270° about a first hinge to the backside of the box, whereupon a second hinge swings acutely to transform the lid into a stand or an easel, thereby providing a desired tilt angle for the open calendar box. Unlike the jewel case pivot point, which is centered along an axis away from the edge of the case, the pivot point of the present invention runs along the intersection of two adjoining panels. This allows the entire panel method calendar box to be constructed as a one-piece unit rather than a two-piece unit, thereby eliminating the high costs involved in a rivot method of assembly.

SUMMARY OF THE INVENTION

The present invention is a box that quickly and conveniently opens to become a tilt back calendar stand for a daily calendar or pad of paper commonly referred to in the trade as a "boxed calendar". This box concept is fundamentally new and has not been previously used in the trade. This box concept provides the following benefits when compared to boxed calendars currently available in the marketplace which are comprised of an outer carton for packaging that is thrown away, a bound pad of paper, and a plastic calendar stand.

1. It is an aspect of the present invention to provide a multi-functional box that serves as packaging, as calendar stand, as storage, as a carrying case, and as a convenient means for the consumer to examine the inner contents prior to purchase.

2. It is another aspect of the present invention to provide a box that quickly and conveniently opens to become a tilt back calendar stand for a boxed calendar, wherein at least two hinges are used on the front lid or cover to create a back stand.

3. It is yet another aspect of the present invention to eliminate the need and associated costs of binding calendar pages, producing plastic stands, gluing the bound pads to the plastic stands, and printing a separate box for packaging, which are currently incurred in the production of typical boxed calendars.

4. It is still another aspect of the present invention to contain loose sheets of paper which comprise the calendar pages within the box. The ability of a boxed calendar to have loose sheets of paper opens the door to a variety of interactive calendar concepts because various elements may be inserted between the loose calendar pages. Currently available boxed calendars are bound at one edge and cannot accommodate many of the interactive calendar concepts of the present invention.

5. It is an aspect of the present invention to provide a calendar page that serves an activity function other than to display calendar information.

6. Yet a further aspect of the present invention is to enable loose calendar pages to be moved to the back of the pad where they can be easily stored and saved for future reference if desired. This feature is of great importance for users using individual pages for activity purposes such as crafts or a calendar which features "reusable" pages such as Accord's "Card-a-Day Calendar" where each calendar page is also a functional card that a user would likely save to send another day, thereby preventing waste. Box calendars do not currently have such a place to store pages.

8. It is yet another aspect of the present invention to provide a calendar stand that can be quickly closed back into the original closed position or mode, which thereby allows for a permanent carrying case.

9. It is an aspect of the present invention to provide a locking system, which may include hook and loop, magnets, and/or other like devices, to hold the lid of the box securely in place, thereby maintaining the interior contents during transport.

10. It is yet another aspect of the present invention to provide a "thumb-hole" insert to facilitate the opening of the locking system whereupon the purchaser can easily examine the inner contents prior to purchase, and then reclose the lid.

11. Another aspect of the present invention is to provide an environmentally responsible alternative to currently available box calendars having throwaway packaging, a throwaway plastic stand, and the use of adhesives.

These and other aspects of this invention will appear from the following description and appended claims, reference being made to the accompanying drawings that form a part of this specification wherein like reference characters designate corresponding parts in the several views.

In summary, the front lid of the box rotates about 270 degrees around to the backside of the box to a semi-locked open position, thereby transforming the lid into a stand or an easel through the use of at least two hinges on the front lid. The force of gravity, which plays an integral role toward maintaining the upright calendar stance, produces a pressure point on the upper back side of the calendar box where the top edge of the front panel of the calendar box makes contact with the back side of the box when the upper hinge is rotated backwards about 270 degrees. Another pressure point is created where the lower hinge is tilted back at an angle to engage a desktop surface. After building many trial and error prototypes, Accord Publishing found that specified hinge and panel locations, which coincide with specified tilt back angles of the calendar along with other variables such as the thickness of the box, bring about a durable sturdy calendar stance position. For example, a box thin in depth will not maintain an upright standing position and/or will easily collapse. Therefore, a box thickness of at least 1¼" is suggested. Similarly, a lower hinge that is located at a short distance from the free end of the front lid will cause the box to collapse. Therefore, a distance of 2½" is discussed. However, it is to be understood that the invention is not limited in its application to the details of the particular arrangements discussed, since the invention is capable of other embodiments.

Having transformed the lid into a stand or easel, a locking system, preferably magnets, may be used to quickly and conveniently fix the stand or easel in the semi-locked position for a sturdy and secure easel stance. A thick pad or set of calendar pages is comprised of individual sheets of paper that are storable in the calendar stand. The storage of loose sheets of paper eliminates the need for hinging or otherwise binding the pages together, i.e., with adhesive, which is the most common method of assembling other boxed type calendars. Moreover, the associated costs of such assemblage are eliminated. Further, the elimination of page binding benefits the user because pages need not be torn off from the bound pad to expose the successive sheet. Without the tearing or rippling that occurs when pages are torn away from traditional bound calendars, a perfect edge can be maintained for all calendar pages. In addition, loose calendar pages benefit the users who wish to use the individual pages for decorative and/or activity purposes. The calendar stand can be quickly closed back into its original closed position or mode and secured with a locking system, preferably by use of magnets.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DESCRIPTION OF THE DISCLOSED EMBODIMENT

Figures 1, 2:
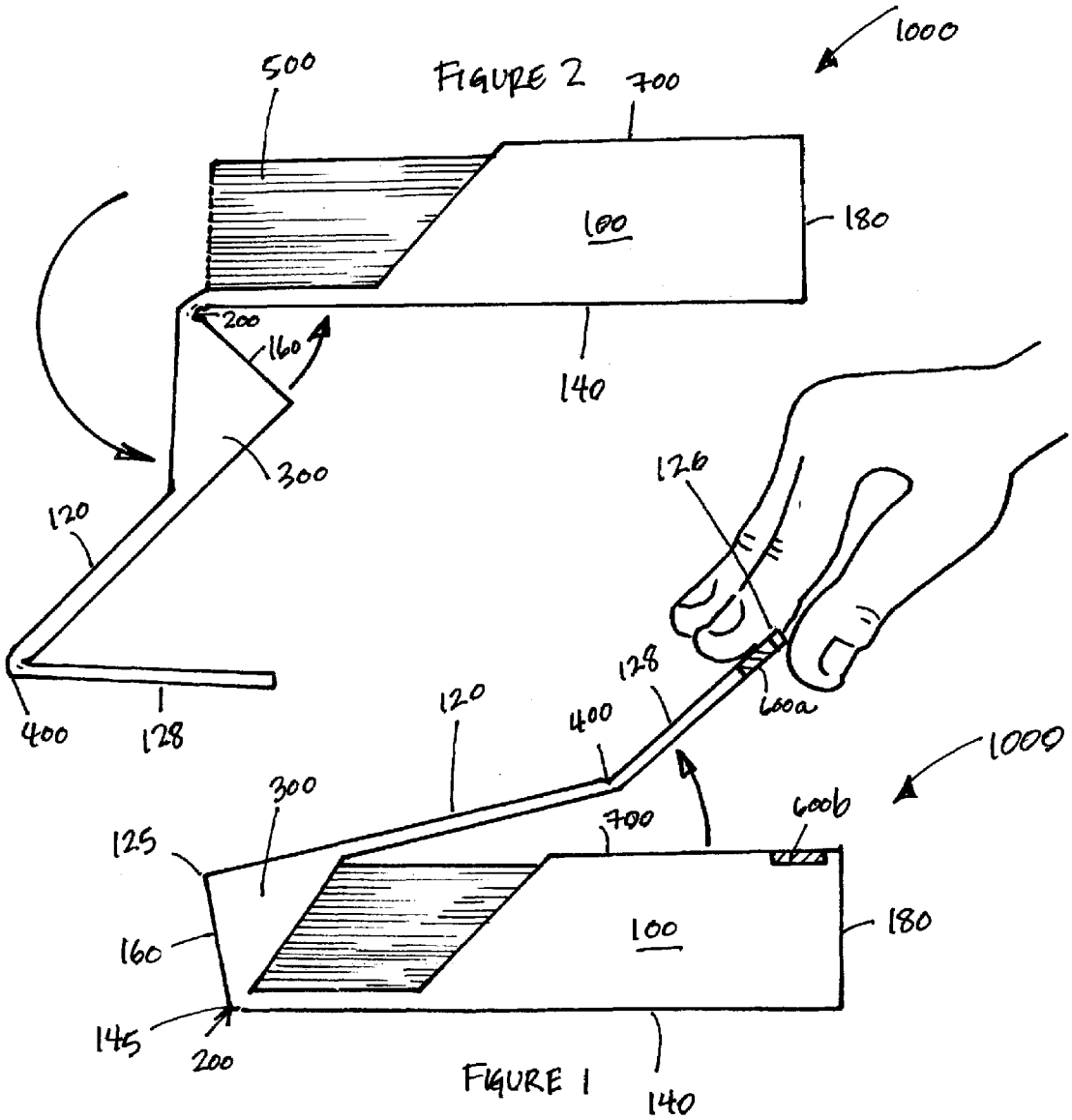
FIG. 1 is a side view of the disclosed embodiment, wherein the front panel of the box is shown being lifted from a closed mode to an open mode.
FIG. 2 is a side view of the embodiment shown in FIG. 1, wherein the front panel of the box is being rotated to the backside of present invention.
Figure 3:
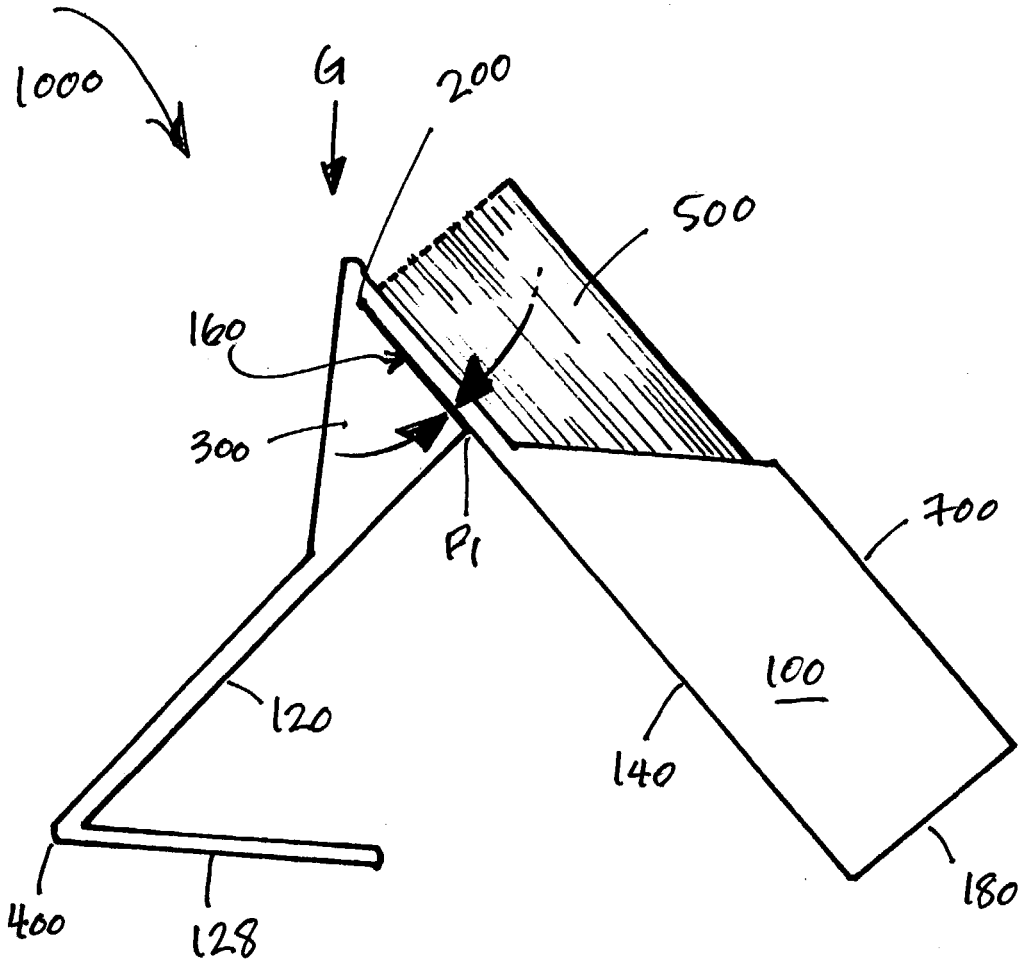
FIG. 3 is a side view of the embodiment shown in FIGS. 1 and 2, wherein the front panel of the box is seated adjacent to the backside of the present invention to form a stand or an easel.

FIGS. 1 to 3 are side views of the invention 1000. These figures depict how the front panel 120 of box 100 is lifted from a closed mode to an open mode, and how front panel 120 is rotated to the backside of invention 1000 where it is seated against the back panel 140 of box 100 to form a stand or an easel. FIGS. 5 to 8 show invention 1000 which has been converted from an open display case or calendar stand to a closed storage box.

There are preferably two working hinges for this device which enable box 100 to turn from a storage/carrying case to become a calendar stand or easel. The box 100 can be made of varied materials including cardboard, plastic and the like. Box 100 is preferably at least 1¼" thick (depth). One hinge 200 is located at the top edge 145 of the back panel 140 of box 100. Hinge 200 is engineered such that the front panel 120 of box 100 may swing a full 270 degrees, along hinge 200, around to the back panel 140 of box 100 until the top surface 160 of box 100 becomes flush with the back panel 140 of box 100. The top surface 160 of box 100 meets the back surface 140 at a 90-degree angle because the front panel 120 is fixed at a right angle through the use of the two angular gussets 300 secured on the sides of box 100. Each gusset 300 preferably extends from the base of hinge 200 downwardly to a point approximately 1½" from the top edge 125 of the front panel 120 of box 100.

The second hinge 400 is located toward the lower to mid portion of the front panel 120 of box 100, approximately 2½" from the bottom edge 126 of the front panel 120. Hinge 400 is engineered such that it enables the lower to mid portion 128 of front panel 120 to swing at an acute angle. When the lower to mid portion 128 of front panel 120 is turned inwardly, a sturdy calendar stand is formed as the entire unit 1000 is leaned back. The position of hinge 400 and the coinciding length of the lower to mid portion 128 will determine the tilt back angle of the calendar stand or easel.

Figure 4:
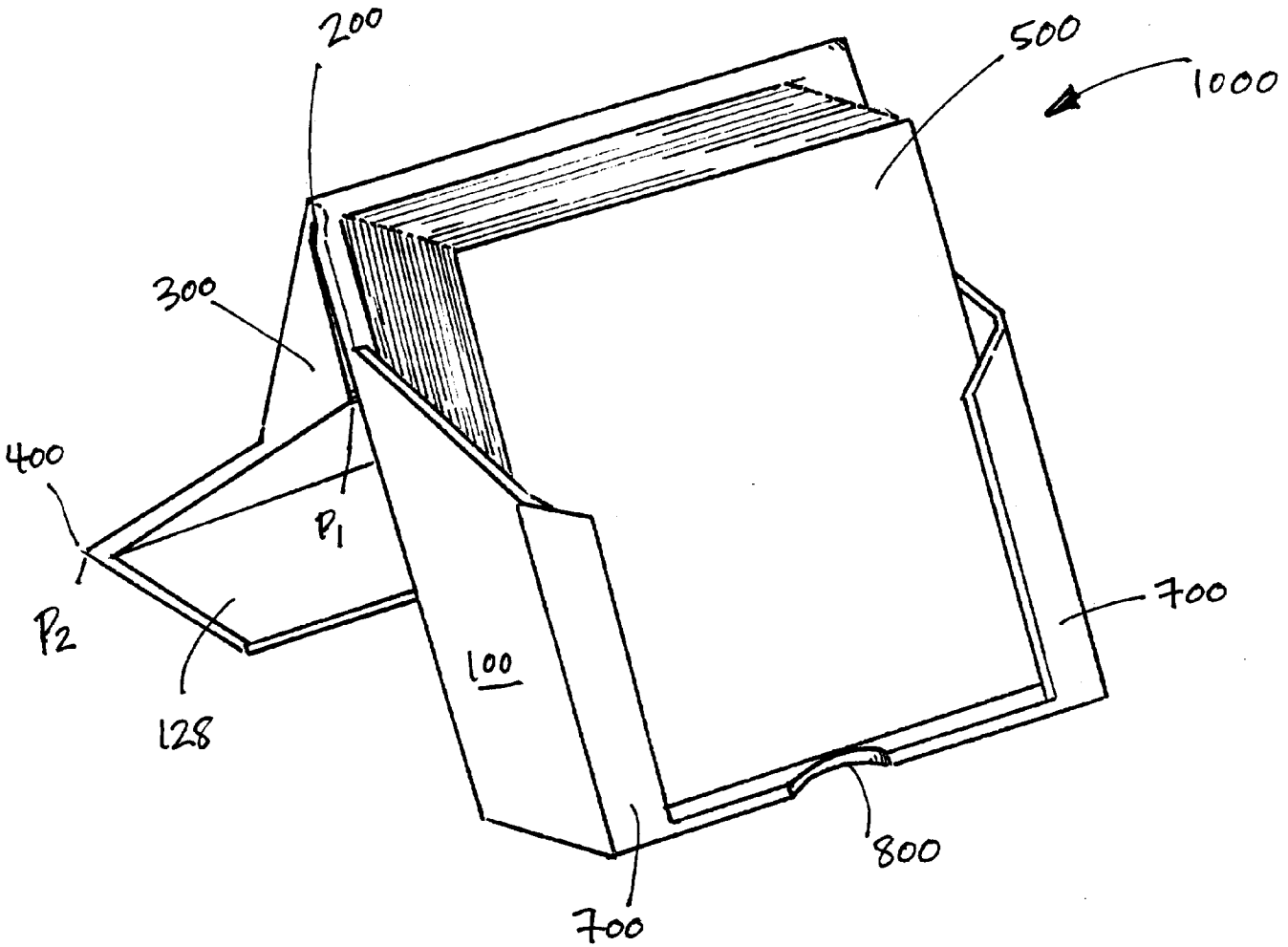
FIG. 4 is a front perspective view of the embodiment shown in FIG. 3, wherein the present invention forms a stand or an easel which supports the embodiment in a slanted upright position.

FIG. 4 is a front perspective view of the embodiment of 1000 shown in FIG. 3. Top surface 160 is seated flush against back panel 140. Front panel 120 is positioned at a 90-degree angle with back panel 140. The force of gravity G creates pressure point P1 against back panel 140. The present invention forms a stand or an easel that supports the embodiment 1000 in a slanted upright position. Pressure point P2 is created when hinge 400 is tilted back at an angle to engage a desktop surface. Stored within box 100 are loose sheets of paper that comprise the calendar pad 500.

Figures 5, 6, 7, 8:
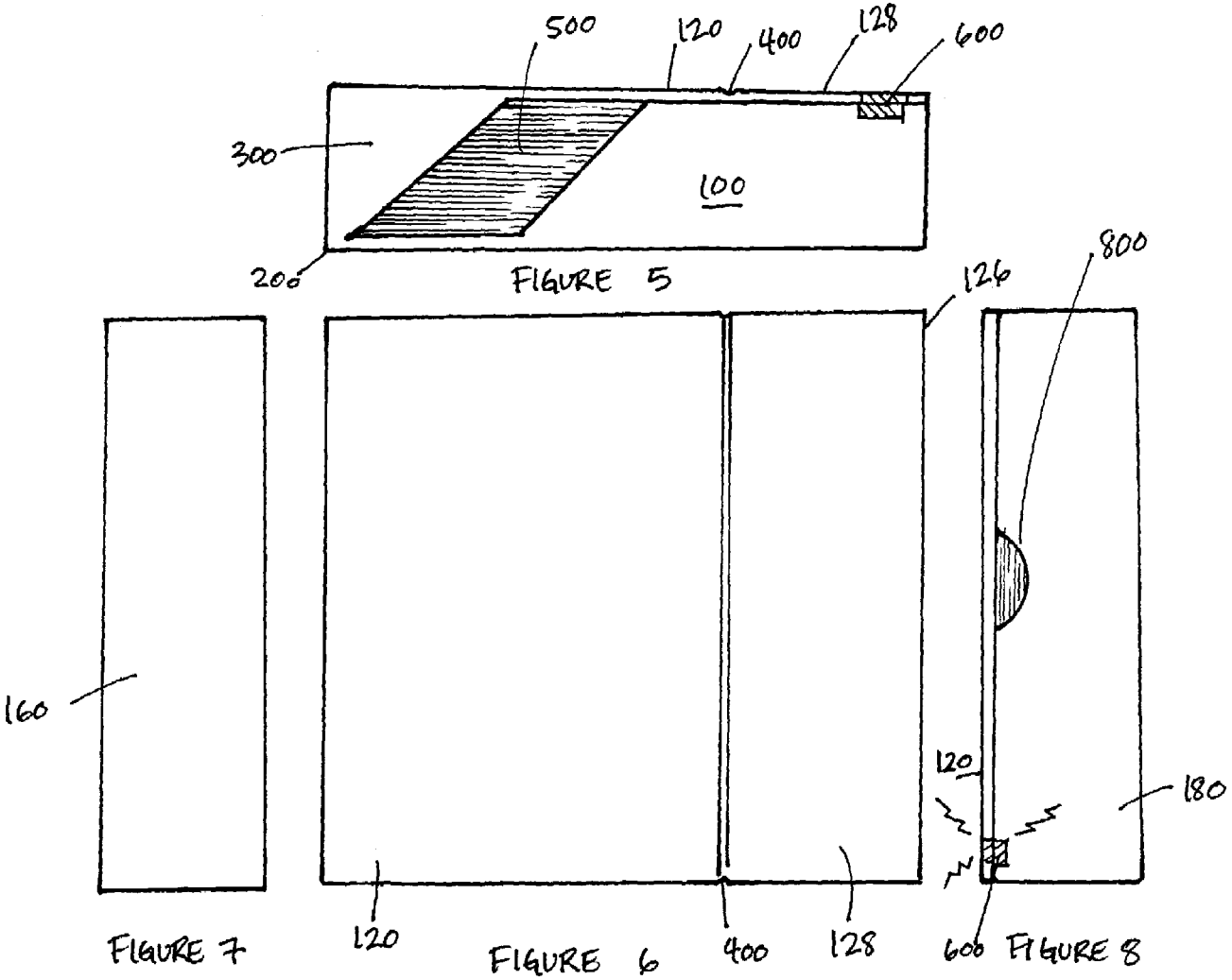
FIG. 5 is a side view of the disclosed embodiment of FIG. 1, wherein the present invention is in a closed and locked mode.
FIG. 6 is a front view of the disclosed embodiment that is shown in the closed and locked mode.
FIG. 7 is a top plan view of the embodiment shown in FIG. 5.
FIG. 8 is bottom plan view of the embodiment shown in FIG. 5 showing an insert thumb hole.

FIG. 5 is a side view of the disclosed embodiment of FIG. 1, wherein invention 1000 is in a closed and locked mode. When closed, a locking system 600, such as magnets or hook and loop, holds the front panel 120 securely in place against box 100, thereby maintaining the interior contents. Mating portion 600*a* located on front panel 120 pairs with mating portion 600*b* located on inner front panel 700 of box 100.

FIG. 6 is a front view of the disclosed embodiment shown in the closed and locked mode. Specifically, FIG. 6 depicts front panel 120 of box 100. Hinge 400 is located adjacent to lower to mid portion 128 approximately 2½" from the bottom edge 126 of front panel 120. FIG. 7 shows top surface 160 of box 100. FIG. 8 shows bottom surface 180 of box 100 wherein invention 1000 is in a closed and locked mode. Mating portion 600*a* located on front panel 120 pairs with mating portion 600*b* located on inner front panel 700 (see FIG. 2) to form locking system 600. Thumbhole insert 800 facilitates the opening of locking system 600.

Figure 9:
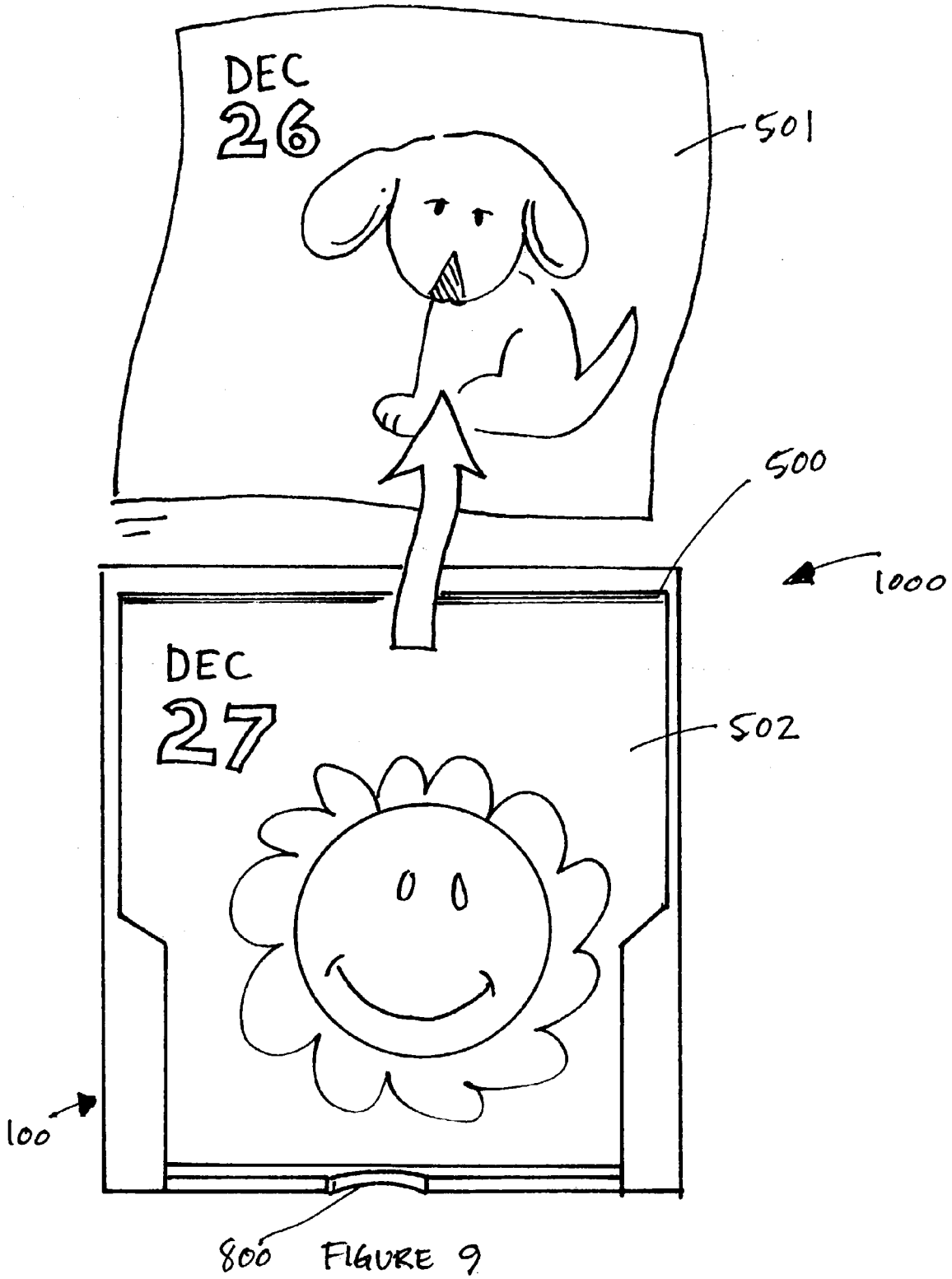
FIG. 9 is a front view of a daily calendar page being removed from its stored position in the disclosed embodiment.

Referring next to FIG. 9, calendar pad 500 is stored in box 100 of the invention 1000. The loose sheets comprising calendar pad 500 can be made of varied materials including paper, cardstock, cardboard, plastic and the like. In this embodiment, a daily calendar page/sheet 501 is being removed from its stored position to expose another daily calendar page/sheet 502. Page/sheet 501 can be moved to the back of the pad 500 where it can be easily stored and saved for future reference if desired. Alternatively, page/sheet 501 could also be moved to a position within pad 500 not at the back of pad 500. Finally, a user could use page/sheet 501 for its designated activity purpose without storing it back in box 100 of the invention 1000.

Figure 10:
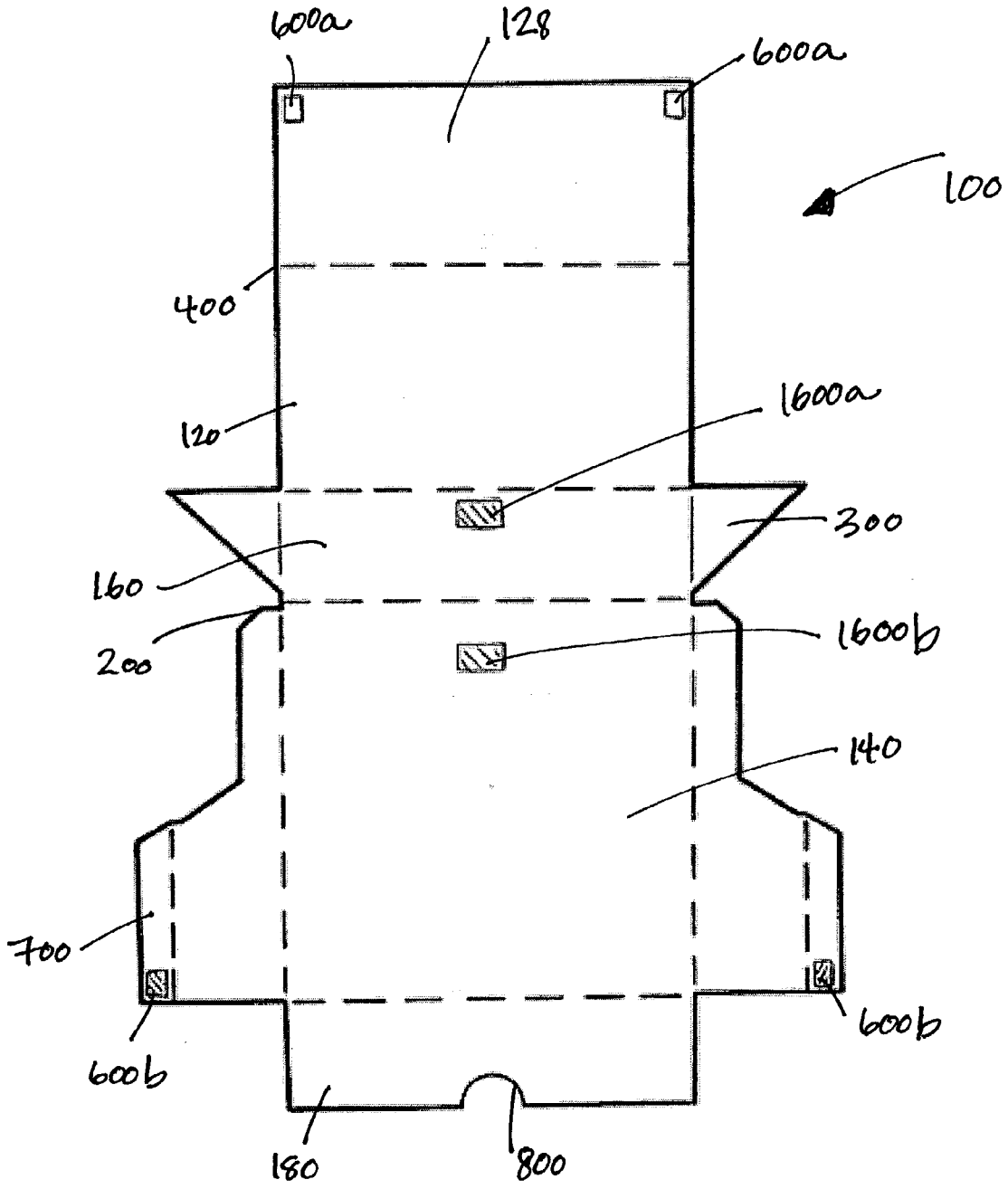
FIG. 10 is a view of one embodiment of a blank which can be used in assembling a container for the pages in the calendar of the present invention.
Figure 11:
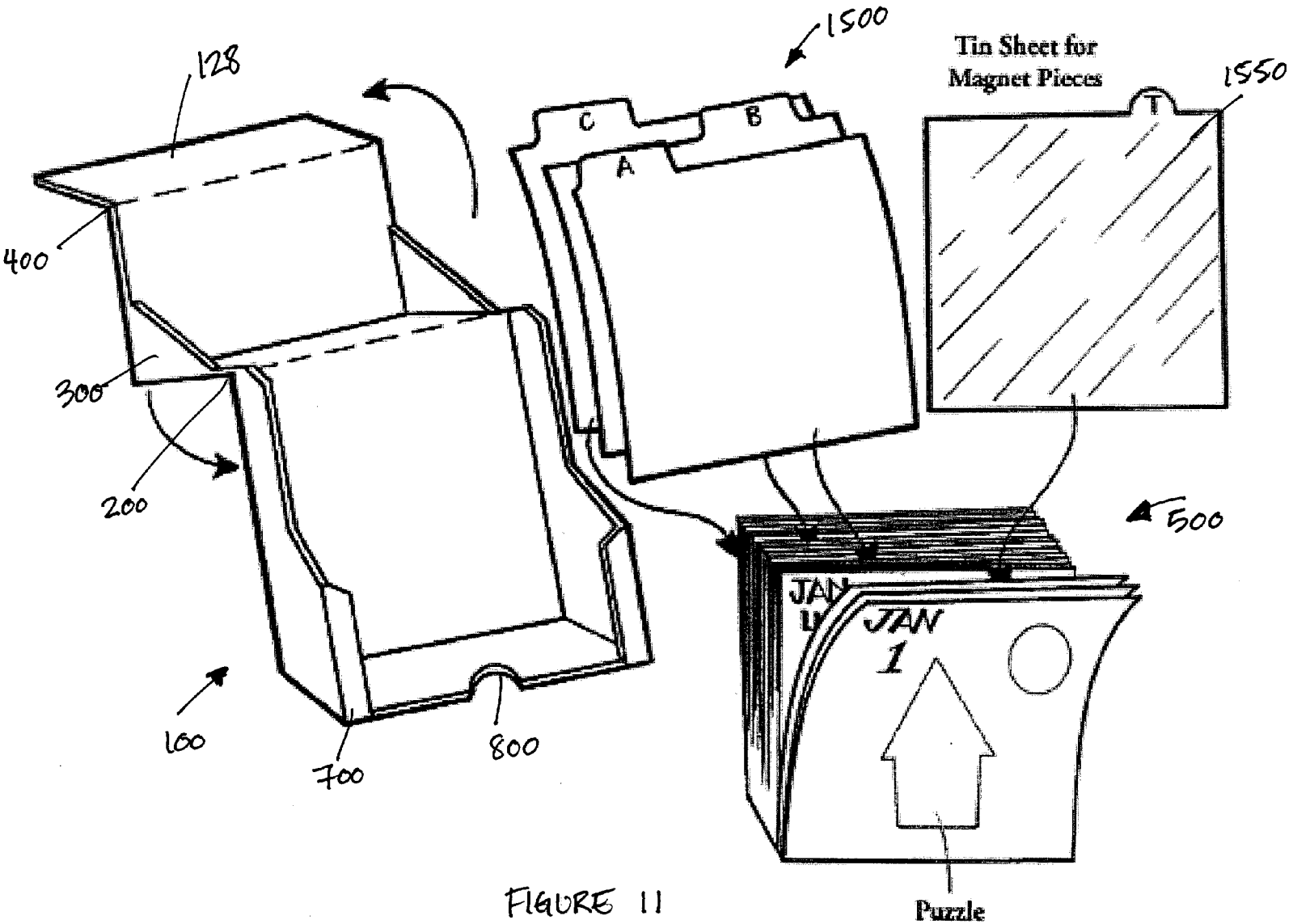
FIG. 11 is a front view of an assembled container embodiment along with insertable divider cards/sheets which may be inserted between sheets of paper that comprise the calendar pad.

FIGS. 10 and 11 show the disassembled and assembled modes of one embodiment of a blank box 100, which can be used in assembling a container of the present invention for the pages in the calendar. In a disassembled mode, the blank box 100 may be flat and is easily storable. The dotted lines on said blank embodiment indicate a suggested folding pattern. A set of magnets 1600 is shown for use in positioning the easel in a standing mode in a semi-locked position when the container is assembled and positioned in its open display configuration. Mating portion 1600*b* located on back panel 140 of box 100 pairs with mating portion 1600*a* located on the top surface 160 of box 100.

As assembled, the blank box 100 forms a container that may receive calendar pad 500. Insertable divider tab cards/sheets 1500, 1550 are ancillary to calendar pad 500 and may be inserted between loose pages of calendar pad 500. When the box 100 is in an open mode, the insertable tab cards/sheets 1500, 1550 may be repositioned between yet other calendar pages by the user to accommodate the desired activity.

Figure 12:
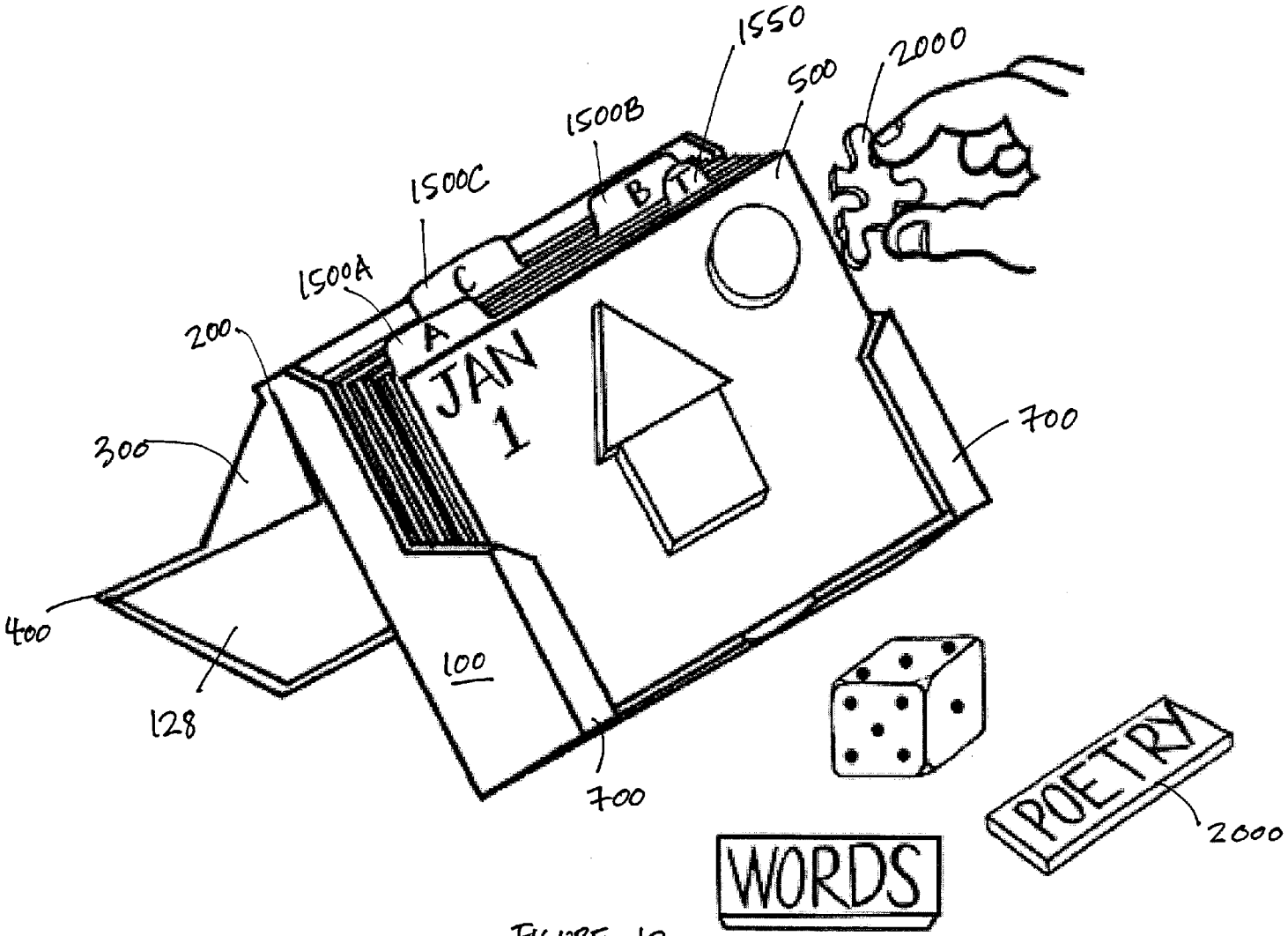
FIG. 12 is a front perspective view of the embodiment shown in FIG. 11.

FIG. 12 is a front perspective view of the embodiment shown in FIG. 11. Stored within box 100 are loose sheets of paper that comprise the calendar pad 500. Insertable divider tab cards/sheets 1500A, 1500B, 1500C are shown inserted between loose pages of calendar pad 500. Insertable divider tab card/sheet 1550 is also shown inserted between loose pages of calendar pad 500, thereby facilitating the desired activity by the user. For example, insertable tab card/sheet 1550 may be made of sheet metal to accommodate a puzzle that involves a variety of magnetic puzzle pieces 2000. The puzzle pieces may take the form of jigsaw pieces, words, geometric shapes, objects, etc. A user may place puzzle piece(s) 2000 on a calendar page at the forefront of insertable tab card/sheet 1550 to accommodate the desired activity involving magnetic puzzles.

Figure 13:
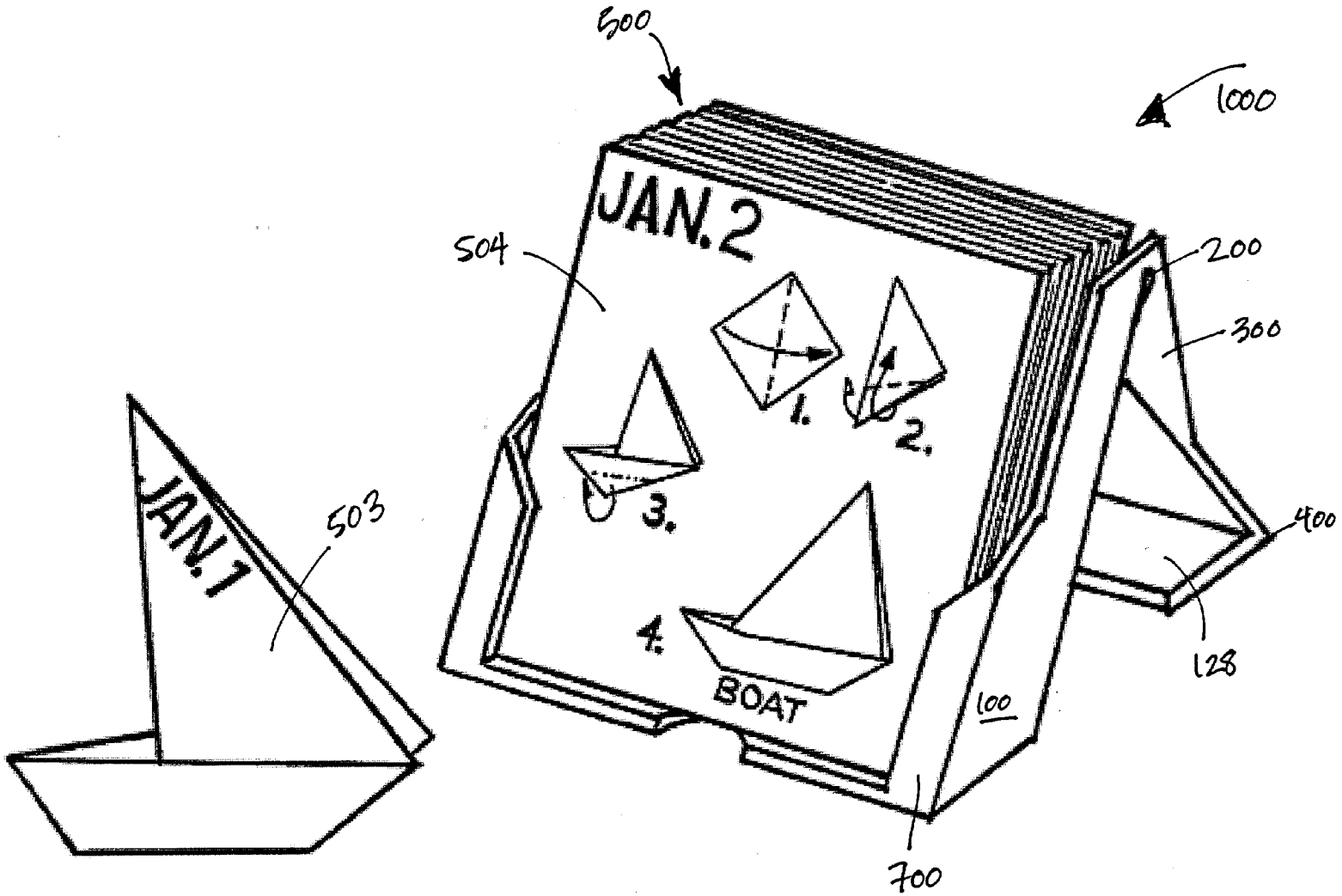
FIG. 13 is a front perspective view of the disclosed embodiment, wherein the present invention forms a stand or an easel which supports the embodiment in a slanted upright position and the pages provide a craft activity.

Referring next to FIG. 13, calendar pad 500 is stored in box 100 of the invention 1000. The present invention forms a stand or an easel which supports the embodiment in a slanted upright position. The loose sheets comprising calendar pad 500 can be made of varied materials including paper, cardstock, cardboard, plastic and the like. In this embodiment, a daily calendar page/sheet 503 has been removed from its stored position to expose daily calendar page/sheet 504. Each loose page of pad 500 can provide a craft activity. In this example, page/sheet 503 provides for a foldable craft activity and is shown in a folded position. If desired, the user may move each loose page of pad 500 to another position within the pad 500 where each can be easily stored and saved for future reference.

Although the present invention has been described with reference to disclosed embodiments, numerous modifications and variations can be made and still the result will come within the scope of the invention. No limitation with respect to the specific embodiments disclosed herein is intended or should be inferred.

We claim:

1. A calendar box system for displaying the individual days of a year, said calendar comprising:

a box having a bottom planar surface adjoined by a pair of sides;

said bottom planar surface having a first hinge located at a top back portion of said bottom planar surface and supporting a closable lid;

said closable lid having a second hinge located at a lower to mid portion thereof;

wherein the lower to mid portion swings at an acute angle to provide a desired tilt angle of said calendar in an open mode;

wherein said closable lid hingedly rotates backwards about 270 degrees to the open mode transforming the lid into a stand, said second hinge producing a pressure point on an upper back portion of said bottom planar surface for maintaining an upright and rigid stance of said lid;

wherein the closable lid hingedly rotates forward about 270 degrees to a closed mode, thereby transforming the box into a carrying case; and wherein said box has at least one calendar page inserted therein.

2. The apparatus of claim 1, wherein the closable lid further comprises at least one gusset, wherein said gusset supports the closable lid at a 90 degree angle to said bottom planar surface in the open mode.

3. The apparatus of claim 1 further comprising a plurality of unbound calendar pages.

4. The apparatus of claim 1 further comprising a lock on the closable lid to secure the closable lid to said box, thereby maintaining said at least one calendar page in the box when said closable lid is in the closed mode.

5. The apparatus of claim 4, wherein the lock further comprises a magnet.

6. The apparatus of claim 4, wherein the lock further comprises hook and loop.

7. The apparatus of claim 3, wherein each of said plurality of calendar pages further comprises an interactive function other than displaying calendar information.

8. The apparatus of claim 3, wherein each of said plurality of calendar pages is removably stored at a position within said box, thereby enabling a user to save any of said plurality of calendar pages for future use.

9. The apparatus of claim 3 further comprising at least one divider insertable between any of said plurality of calendar pages.

10. The apparatus of claim 9, wherein the insertable divider is metal.

11. The apparatus of claim 1 further comprising a fastener for securing said closable lid in the upright and rigid stance, said fastener located at the upper back portion of said bottom planar surface and inwardly adjacent to said pressure point.

12. The apparatus of claim 11, wherein the fastener further comprises a magnet.

13. The apparatus of claim 4 further comprising a thumbhole insert to facilitate the opening of the lock.

14. The apparatus of claim 1, wherein the calendar page is reusable.

15. A calendar comprising:

box means having a bottom planar surface adjoined by a pair of sides, said box means functioning to store at least one calendar page means therein, said calendar page means functioning to display calendar information;

said bottom planar surface having a first hinge means located at a top portion of said bottom planar surface, said first hinge means functioning to rotate a closable lid means backwards about 270 degrees to an open mode, said bottom planar surface supporting said closable lid means;

said closable lid means functioning to provide a stand for the calendar in the open mode;

said closable lid means having a second hinge means located at a lower to mid portion thereof, said second hinge means functioning to swing the lower to mid portion of said closable lid means at an acute angle to provide a desired tilt angle of said calendar in the open mode;

said second hinge means further functioning to produce a pressure point on an upper back portion of said bottom planar surface for maintaining an upright and rigid stance of said closable lid means; and wherein the closable lid means hingedly rotates forward about 270 degrees to a closed mode transforming the box means into a carrying case.

16. The apparatus of claim 15, wherein the closable lid means further comprises gusset means functioning to support the closable lid means at a right angle to said bottom planar surface in the open mode.

17. The apparatus of claim 15 further comprising a plurality of unbound calendar page means functioning to display calendar information.

18. The apparatus of claim 15 further comprising lock means on the closable lid means, said lock means functioning to secure the closable lid means to said box means, thereby maintaining said at least one calendar page means in the box means when said closable lid means is in the closed mode.

19. The apparatus of claim 18, wherein the lock means further comprises a magnet.

20. The apparatus of claims 18, wherein the lock means further comprises hook and loop.

21. The apparatus of claim 17, wherein each of said plurality of calendar page means further comprises an interactive function.

22. The apparatus of claim 17, wherein each of said plurality of calendar page means is removably stored at a position within said box means, thereby enabling a user to save any of said plurality of calendar page means for future use.

23. The apparatus of claim 17 further comprising at least one divider means, said divider means functioning to be inserted between any of said plurality of calendar page means.

24. The apparatus of claim 23, wherein said insertable divider means is metal.

25. The apparatus of claim 18 further comprising a thumbhole insert means functioning to facilitate the opening of the lock means.

26. The apparatus of claim 15, wherein the calendar page means is reusable.

27. The apparatus of claim 15 further comprising fastener means functioning to secure said closable lid means in the upright and rigid stance, said fastener means located at the upper back portion of said bottom planar surface and inwardly adjacent to said pressure point.

28. The apparatus of claim 27, wherein said fastener means further comprises a magnet.

29. A calendar for displaying the days of a year, said calendar comprising:

a box having a bottom planar surface adjoined by a pair of sides;

said bottom planar surface having a first hinge located at a top back portion of said bottom planar surface and supporting a closable lid;

said closable lid having a second hinge located at a lower to mid portion thereof;

wherein the lower to mid portion swings at an acute angle to provide a desired tilt angle of said calendar in an open mode;

wherein said closable lid hingedly rotates backwards about 270 degrees to the open mode transforming the lid into a stand, said second hinge producing a pressure point on an upper back portion of said bottom planar surface for maintaining an upright and rigid stance of said lid;

wherein the closable lid hingedly rotates forward about 270 degrees to a closed mode, thereby transforming the box into a carrying case;

wherein said box has at least one calendar page inserted therein; and wherein said box comprises a lock on the closable lid to secure the closable lid to said box, thereby maintaining said calendar page in the box when said closable lid is in the closed mode.

30. The apparatus of claim 29, wherein the closable lid further comprises at least one gusset, wherein said gusset supports the closable lid at a 90 degree angle to said bottom planar surface in the open mode.

31. The apparatus of claim 29 further comprising a plurality of unbound calendar pages.

32. The apparatus of claim 31, wherein each of said plurality of calendar pages further comprises an interactive function other than displaying calendar information.

33. The apparatus of claim 29 further comprising a thumbhole insert to facilitate the opening of the lock.

34. The apparatus of claim 31 further comprising at least one divider insertable between any of said plurality of calendar pages.

35. The apparatus of claim 34, wherein said insertable divider is metal.

36. The apparatus of claim 29 further comprising a fastener for securing said closable lid in an upright and rigid stance, said fastener located at the upper back portion of said bottom planar surface and inwardly adjacent to said pressure point.

37. The apparatus of claim 36, wherein said fastener further comprises a magnet.

38. A calendar for displaying the days of a year, said calendar comprising:

a box having a bottom planar surface adjoined by a pair of sides;

said bottom planar surface having a first hinge located at a top back portion of said bottom planar surface and supporting a closable lid;

said closable lid having a second hinge located at a lower to mid portion thereof;

wherein the lower to mid portion swings at an acute angle to provide a desired tilt angle of said calendar in an open mode;

wherein said closable lid hingedly rotates backwards about 270 degrees to the open mode transforming the lid into a stand, said second hinge producing a pressure point on an upper back portion of said bottom planar surface for maintaining an upright and rigid stance of said lid;

wherein the closable lid hingedly rotates forward about 270 degrees to a closed mode, thereby transforming the box into a carrying case;

wherein said box has at least one calendar page inserted therein;

wherein said box comprises a lock on the closable lid to secure the closable lid to said box, thereby maintaining said calendar page in the box when said closable lid is in the closed mode;

wherein said box has at least one metal divider inserted therein adjacent to said calendar page, thereby enabling a magnet to be attracted to said metal divider adjacent to said calendar page.

39. The apparatus of claim 38, wherein the closable lid further comprises at least one gusset, wherein said gusset supports the closable lid at a right angle to said bottom planar surface in the open mode.

40. The apparatus of claim 38 further comprising a plurality of unbound calendar pages.

41. The apparatus of claim 40, wherein each of said plurality of calendar pages further comprises an interactive function other than displaying calendar information.

42. The apparatus of claim 41, wherein said magnet is a puzzle piece coordinated with the interactive function of each of said plurality of calendar pages.

43. The apparatus of claim 38, wherein said magnet is a puzzle piece.

44. The apparatus of claim 38 further comprising a thumbhole insert to facilitate the opening of the lock.

* * * * *